US007467655B2

(12) United States Patent
Beddard et al.

(10) Patent No.: US 7,467,655 B2
(45) Date of Patent: Dec. 23, 2008

(54) PERIMETER-COOLED STAGE 1 BUCKET CORE STABILIZING DEVICE AND RELATED METHOD

(75) Inventors: Thomas B. Beddard, Simpsonville, SC (US); Kenneth L. Parks, Clarksville, TN (US)

(73) Assignee: General Electric Co., Schenectady, NY (US)

( * ) Notice: Subject to any disclaimer, the term of this patent is extended or adjusted under 35 U.S.C. 154(b) by 33 days.

(21) Appl. No.: 11/605,457

(22) Filed: Nov. 29, 2006

(65) Prior Publication Data

US 2007/0131379 A1 Jun. 14, 2007

Related U.S. Application Data

(63) Continuation-in-part of application No. 10/604,220, filed on Jul. 1, 2003, now abandoned.

(51) Int. Cl.
*B22C 9/10* (2006.01)

(52) U.S. Cl. ..... 164/369; 164/370

(58) Field of Classification Search ..... 164/369, 164/370; 264/274, 275

See application file for complete search history.

(56) References Cited

U.S. PATENT DOCUMENTS

| | | | | |
|---|---|---|---|---|
| 3,981,344 | A | 9/1976 | Hayes et al. | 164/516 |
| 4,017,210 | A | 4/1977 | Darrow | 416/97 R |
| 4,023,249 | A | 5/1977 | Darrow et al. | 29/889.721 |
| 4,023,251 | A | 5/1977 | Darrow | 29/889.74 |
| 4,040,159 | A | 8/1977 | Darrow et al. | 29/889.721 |
| 4,183,456 | A | 1/1980 | Schilling et al. | 228/175 |
| 4,185,369 | A | 1/1980 | Darrow et al. | 29/889.722 |
| 4,283,835 | A * | 8/1981 | Obrochta et al. | 29/527.6 |
| 4,302,153 | A | 11/1981 | Tubbs | 416/96 R |
| 4,497,613 | A | 2/1985 | Carreno | 416/228 |
| 5,947,181 | A | 9/1999 | Davis | 164/132 |
| 5,950,705 | A | 9/1999 | Huang | 164/137 |
| 6,234,753 | B1 * | 5/2001 | Lee | 416/97 R |
| 6,340,047 | B1 | 1/2002 | Frey | 164/137 |
| 6,390,774 | B1 | 5/2002 | Lewis et al. | 416/96 R |
| 6,464,462 | B2 | 10/2002 | Stathopoulos et al. | 416/96 R |
| 6,467,534 | B1 | 10/2002 | Klug et al. | 164/517 |
| 6,712,120 | B2 | 3/2004 | Tiemann | 164/137 |
| 2004/0094287 | A1 | 5/2004 | Wang | 164/361 |

FOREIGN PATENT DOCUMENTS

| | | |
|---|---|---|
| EP | 1 022 434 A2 * | 7/2000 |
| EP | 1022434 A2 | 7/2000 |
| GB | 2346340 | 8/2000 |

* cited by examiner

*Primary Examiner*—Kevin P Kerns
(74) *Attorney, Agent, or Firm*—Nixon & Vanderhye P.C.

(57) ABSTRACT

A core for use in casting a gas turbine bucket includes a solid, curved upper body portion and a pair of co-planar legs extending downwardly from the solid, curved upper body portions. The pair of legs are separated by an elongated open slot extending from a lower end of the core upwardly more than half a height dimension of the core, into the upper body portion. A pair of axially aligned pegs project in axially opposite directions from opposite sides of the solid, curved upper body portion, perpendicular to and above the elongated slot but spaced from an upper edge of the solid, curved upper body portion. The pair of pegs lie substantially in a plane containing the co-planar legs, and in a radial direction, the pegs are closer to the elongated slot than to the upper edge.

5 Claims, 2 Drawing Sheets

Fig. 1
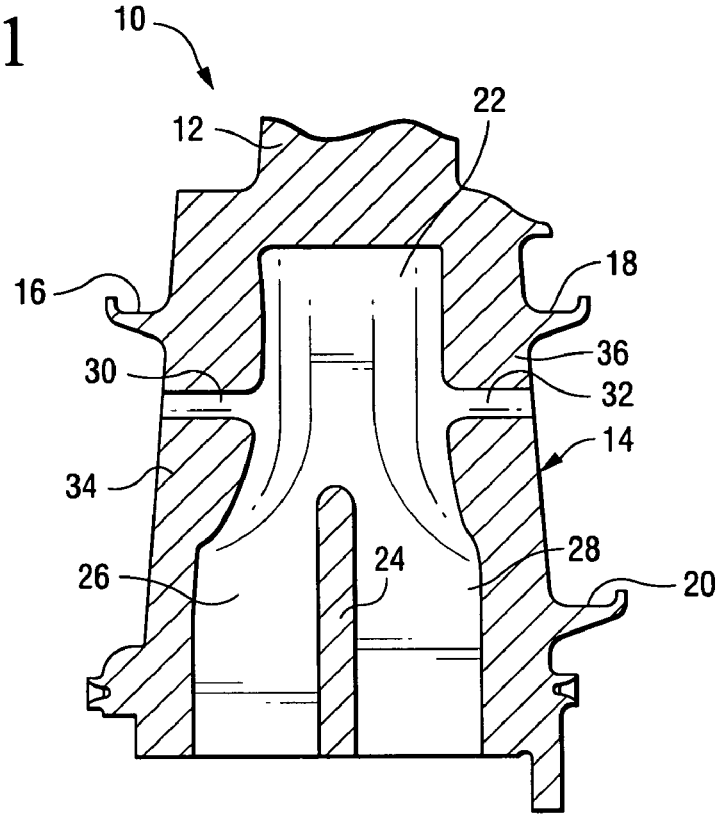
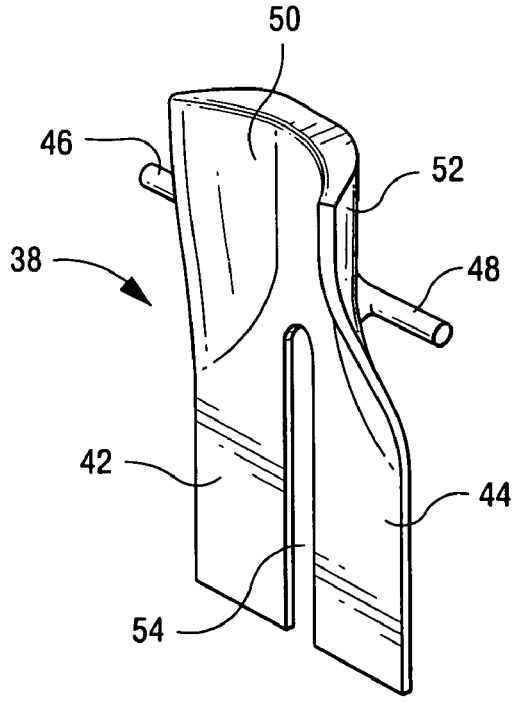
Fig. 2

PERIMETER-COOLED STAGE 1 BUCKET CORE STABILIZING DEVICE AND RELATED METHOD

This application is a Continuation-in-Part of application Ser. No. 10/604,220, filed Jul. 1, 2003, now abandoned.

This invention relates generally to the casting of perimeter-cooled buckets for a gas turbine and, more specifically, to a stabilization device for an internal core used in the bucket casting process.

BACKGROUND OF THE INVENTION

In an effort to improve the cooling scheme of a stage 1 gas turbine bucket, a "pants-leg" shaped core has been used in the bucket shank portion of the shell die to form a pair of cooling passages in place of a previous design utilized to form a plurality of radial cooling holes. In the casting process, wax inserts (cores) are covered in plaster and then the wax is melted away. When the thin legs of the wax core were covered with plastic, however, the core tended to drift significantly, resulting in wall thicknesses in the shank portion of the bucket being out of tolerance.

Core stabilizing devices or "printouts" for improving the yield of a bucket casting process have been previously used in stage 2 buckets, but with a different core design and in a different location relative to the so-called angel wings on the exterior of the shank portion of the bucket. Because of the different design of the stage 1 and stage 2 buckets, it was not possible to simply scale up the stage 2 bucket core for use in the stage 1 bucket casting process.

Accordingly, there is a need for a core constructed to better secure the core in the place, especially during the plastic stage of the casting process.

BRIEF DESCRIPTION OF THE INVENTION

This invention provides stabilization devices on the core used for casting stage 1 gas turbine buckets. Because of the interior configuration of the shank portion of the bucket, and in light of the desire to have the stabilizing devices laterally aligned, it was necessary to move the stabilizing devices or printouts radially downwardly in the shell die so as to be located below the external angel wings of the cast bucket.

It is also a feature of the present invention that the cross sectional shape of the stabilization devices or printouts is of elliptical rather than the oblong or rounded rectangular shape used with the printouts for the casting of stage 2 buckets. By making the printouts elliptical in cross-sectional shape, the flat surfaces of the prior design have been eliminated, and stresses, particularly at the intersection of the printouts and the core, have been reduced.

Accordingly, in one aspect, the present invention relates to a core for use in casting a gas turbine bucket, the core comprising a solid, curved upper body portion and a pair of co-planar legs extending downwardly from the solid, curved upper body portion, the pair of legs separated by an elongated open slot extending from a lower end of the core upwardly more than half a height dimension of the core, into the upper body portion, and a pair of axially aligned pegs projecting in axially opposite directions from opposite sides of the solid, curved upper body portion, perpendicular to and above the elongated slot but spaced from an upper edge of the solid, curved upper body portion, the pair of pegs lying substantially in a plane containing the co-planar legs, and wherein, in a radial direction, the pegs are closer to the elongated slot than to the upper edge.

In another aspect, the invention relates to a core for use in casting a gas turbine bucket, the core comprising a solid, curved upper body portion and a pair of legs extending downwardly from said solid, curved upper body portion, said pair of legs lying in a common plane, separated by an elongated open slot extending from a lower end of said core upwardly more than half a height dimension of the core, into said upper body portion, and a pair of pegs projecting in axially opposite directions from opposite sides of said solid, curved upper body portion, above said elongated slot but spaced from an upper edge of said solid, curved upper body portion; wherein said pegs are elliptical in cross section, and further wherein said solid curved upper body portion has opposite concave and convex surfaces, said pegs lying substantially in said common plane, extending from the convex surface of said solid, curved upper body portion, perpendicular to the elongated open slot.

In still another aspect, the invention relates to a method of controlling wall thickness in the shank portion of a turbine bucket during casting comprising: a) providing a core comprising a solid upper body portion and a pair of legs extending downwardly from the solid upper body portion, the legs separated by an elongated slot; b) supporting the core within a shell die by a pair of axially aligned pegs extending from opposite sides of the solid upper body portion, the pegs located above the slot and below an upper edge of the upper body portion, lying substantially in a plane containing the co-planar legs.

The invention will now be described in connection with the drawings identified below.

BRIEF DESCRIPTION OF THE DRAWINGS

FIG. 1 is a partial cross section of a shank portion of a stage 1 bucket cast in accordance with the invention;

FIG. 2 is a perspective view of a core used in casting the bucket shown in FIG. 1;

DETAILED DESCRIPTION OF THE INVENTION

Figure 5:
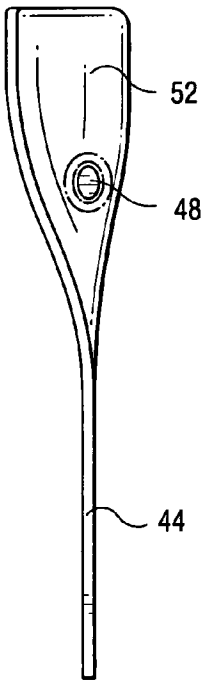
FIG. 5 is a side elevation of the core shown in FIGS. 2-4.
Figure 4:
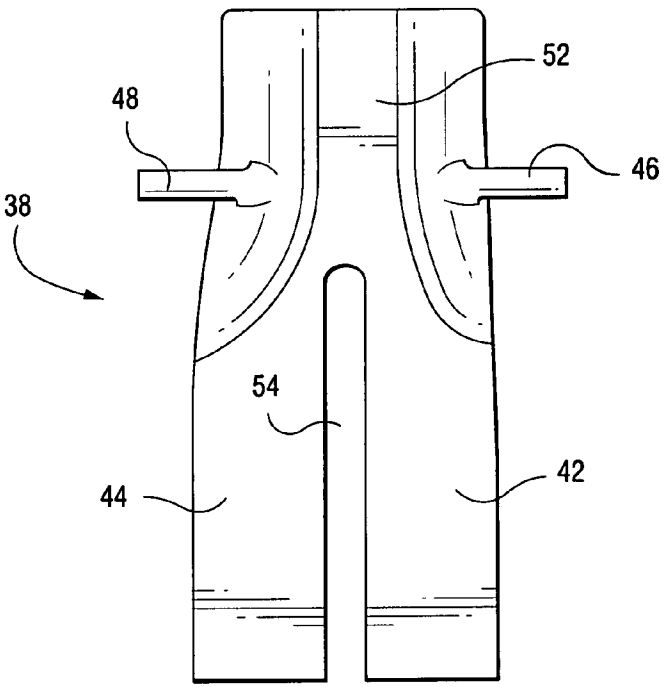
FIG. 4 is a rear elevation of the core shown in FIG. 1.

With reference to FIG. 1, a stage 1 turbine bucket 10 includes an airfoil portion 12 and a shank portion or shank 14. The shank includes a plurality of so-called angel wings 16, 18 and 20 that serve as seals vis-a-vis adjacent buckets when installed on the rotor wheel of a gas turbine. The interior of the shank portion includes a hollow space 22, with a central divider 24 that establishes side-by-side cooling passages 26 and 28. Elliptical holes 30 and 32 are cast in the fore and aft shank walls 34 and 36, respectively, as a byproduct of having the core supported in the shell die during casting.

Figure 3:
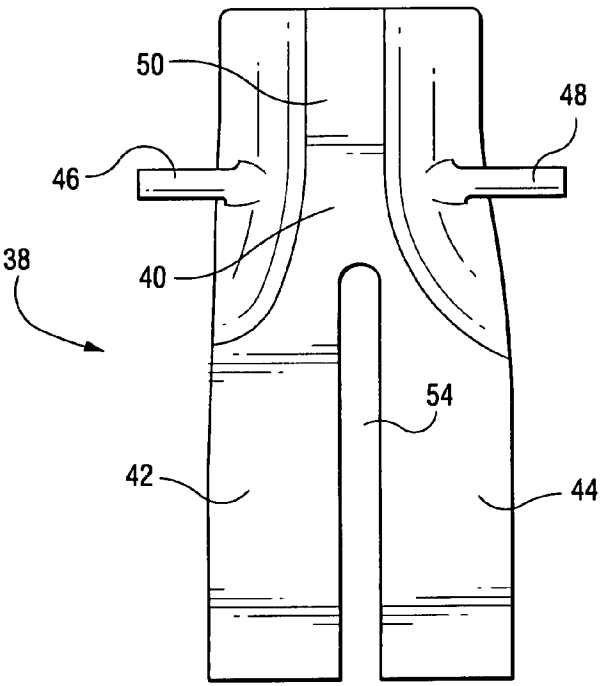
FIG. 3 is a front elevation of the core shown in FIG. 2.

Turning to FIGS. 2-5, the core 38 has a generally "pants-leg" shape with a solid upper body portion 40 and a pair of radially inwardly extending co-planar legs 42 and 44 in accordance with an exemplary embodiment of the invention. A pair of axially aligned stabilizing pegs or printouts 46, 48 extend in axially opposite directions from opposite sides of the core while an elongated radially extending open slot 54 separates the pants-leg portions 42 and 44. Notice that the core is curved in its solid upper portion so as to provide convex and concave surfaces (50, 52), respectively, and that the slot extends from a lower end of the core upwardly more than half a height dimension of the core, with pegs 46, 48 extending perpendicular to the slot. As best seen in FIG. 3, pegs 46, 48 also lie in substantially the same plane as legs 42, 44, and are closer, in a radial direction, to the elongated slot 54 than to the upper edge of the upper body portion.

It will be appreciated that in the casting process, the reinforcing pegs or printouts 46, 48 will be supported within aligned holes in the shell die, thus forming holes 30, 32 in the fore and aft walls of the shank portion of the cast bucket. At the same time, the slot 54 will create the center partition 24.

By locating the stabilizing pegs or printouts 46, 48 radially below the angel wings 16, 18, sufficient room is provided so that the printouts 46, 48 may be directly across from one another, i.e., aligned both axially and radially. This location is also one of relatively low stress. After the casting process is completed, and the core removed, holes 30, 32 remain in the bucket and must be plugged. By laterally aligning the holes 30, 32, plugs can be inserted and press fit simultaneously in the holes 30, 32 from opposite directions, without creating any asymmetrical stresses on the bucket.

It is also a feature of this invention, as best seen in FIG. 5, that the stabilizing pegs or printouts 46, 48 have a cross sectional shape that is elliptical. The elliptical cross-sectional shape further reduces stress at the intersection of the printouts and respective ends of the core by eliminating flat surfaces. When the casting process has been completed, the elliptical holes may be redrilled to a round shape and plugged with cylindrical plugs.

The core 38 as described herein is more capable of removing heat from the shank than standard STEM drilled holes due to an increase in surface area. This core design pulls an additional 10° F. of bulk metal temperature from the airfoil. In this regard, it is generally accepted that a decrease of 20° F. roughly doubles the creep life of the part.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A core for use in casting a gas turbine bucket, the core comprising a solid, curved upper body portion and a pair of co-planar legs extending downwardly from said solid, curved upper body portion, said pair of legs separated by an elongated open slot extending from a lower end of said core upwardly more than half a height dimension of the core, into said upper body portion, and a pair of integral, axially aligned pegs projecting in axially opposite directions from opposite sides of said solid, curved upper body portion, perpendicular to and above said elongated slot but spaced from an upper edge of said solid, curved upper body portion, said pair of pegs lying substantially in a plane containing said co-planar legs, and wherein, in a radial direction, said pegs are closer to said elongated slot than to said upper edge.

2. The core of claim 1 wherein said solid upper body portion has opposite concave and convex surfaces, said pegs extending from the convex surface of said solid upper body portion.

3. The core of claim 1 wherein said pegs are elliptical in cross section.

4. The core of claim 2 wherein said pegs are elliptical in cross section.

5. A core for use in casting a gas turbine bucket, the core comprising a solid, curved upper body portion and a pair of legs extending downwardly from said solid, curved upper body portion, said pair of legs lying in a common plane, separated by an elongated open slot extending from a lower end of said core upwardly more than half a height dimension of the core, into said upper body portion, and a pair of integral pegs projecting in axially opposite directions from opposite sides of said solid, curved upper body portion, above said elongated slot but spaced from an upper edge of said solid, curved upper body portion; wherein said pegs are elliptical in cross section, and further wherein said solid curved upper body portion has opposite concave and convex surfaces, said pegs lying substantially in said common plane, extending from the convex surface of said solid, curved upper body portion, perpendicular to the elongated open slot.

* * * * *